US005923350A

United States Patent [19]

Ohnishi et al.

[11] Patent Number: 5,923,350

[45] Date of Patent: Jul. 13, 1999

[54] RECORDING APPARATUS WITH IMPROVED HEAD INSTALLATION MECHANISM

[75] Inventors: Toshiyuki Ohnishi; Shinji Kanemitsu; Makoto Kashimura, all of Yokohama; Makoto Takemura, Tokyo; Tetsuhiro Nitta, Yokohama; Yasuhiro Unosawa, Tokyo; Satoshi Saikawa, Inagi; Hiroshi Yoshino, Yokohama, all of Japan

[73] Assignee: Canon Kabushiki Kaisha, Tokyo, Japan

[21] Appl. No.: 08/300,340

[22] Filed: Sep. 2, 1994

[30] Foreign Application Priority Data

Sep. 3, 1993 [JP] Japan ..... 5-219806
Aug. 31, 1994 [JP] Japan ..... 6-207803

[51] Int. Cl.[6] ..... B41J 2/14; B41J 2/16

[52] U.S. Cl. ..... 347/50

[58] Field of Search ..... 347/49, 50, 85, 347/86, 37, 87

[56] References Cited

U.S. PATENT DOCUMENTS

| | | | |
|---|---|---|---|
| 4,692,778 | 9/1987 | Yoshimura et al. | 346/145 |
| 4,736,213 | 4/1988 | Piatt et al. . | |
| 4,755,836 | 7/1988 | Ta et al. . | |
| 4,907,018 | 3/1990 | Pinkerpell et al | 346/139 |
| 5,105,210 | 4/1992 | Hirano et al. | 346/145 |
| 5,138,342 | 8/1992 | Kurata et al. . | |
| 5,194,015 | 3/1993 | Yamamoto et al. | 439/484 |
| 5,235,353 | 8/1993 | Hirano et al. | 346/145 |
| 5,245,361 | 9/1993 | Kashimura et al. | 347/50 |

FOREIGN PATENT DOCUMENTS

| | | |
|---|---|---|
| 0313205 | 4/1989 | European Pat. Off. . |
| 0379151 | 7/1990 | European Pat. Off. . |
| 0622234 | 11/1994 | European Pat. Off. . |
| 58-194542 | 11/1983 | Japan . |

*Primary Examiner*—N. Le
*Assistant Examiner*—L. Anderson
*Attorney, Agent, or Firm*—Fitzpatrick, Cella, Harper & Scinto

[57] ABSTRACT

An ink-jet recording apparatus includes a positioning device for postioning a recording head on a carriage and an electrical connecting device for establishing electrical connection between the recording head and a main body portion. The positioning device and the electrical connecting device are provided on the carriage independently of each other. Therefore, the recording head and an ink tank can be certainly and simply installed on the recording apparatus. Also, an information processing system employs such recording apparatus to output input information, such as characters, image or so forth on a recording medium.

32 Claims, 10 Drawing Sheets

RECORDING APPARATUS WITH IMPROVED HEAD INSTALLATION MECHANISM

BACKGROUND OF THE INVENTION

1. Field of the Invention

The present invention relates to a recording apparatus having a mechanism for mounting a head as means for forming an image on a recording medium by ejecting an ink. More specifically, the invention relates to a recording apparatus having a head installation mechanism which is improved both in installation of a signal transmitting portion for transmitting a recording signal to a head and in installation of the head per se.

2. Description of the Related Art

One of recording systems recently attracting attention is an ink-jet recording system. The ink-jet recording system is a non-impact type recording system and records input information, such as characters, images or so forth, by directly adhering ink (forming dot) on a recording medium (paper, cloth, plastic sheet and so forth)

The recording apparatus having such ink-jet type recording head (ink-jet recording head) is attracting attention as the recording system which satisfies demands for high speed recording, high resolution, high image quality, low noise and so forth. The ink-jet type recording apparatus has thus been employed as printers for copy machines, facsimiles, printers, word processors, output terminals of work stations and so forth, handy or portable printers to be employed in personal computers, host computers, optical disk systems, video systems and so forth.

Particularly, in the recent years, in viewpoint of downsizing, capability of full-color printing and effective use of disposable material, there have been proposed a recording apparatus having a construction, in which a recording head and an irk tank storing ink to be supplied to the recording head are mounted on a carriage.

For example, when an ink-jet cartridge, in which the recording head and the ink tank are integrally constructed is installed on the carriage, it becomes necessary to achieve both of positioning (contact) of a signal transmitting portion for transmitting a recording signal to the recording head and accurate positioning of the ink-jet cartridge per se.

One example of installation structure of ink-jet cartridge on the carriage aha been disclosed in U.S. Pat. No. 4,907,018. In the above-identified U.S. Patent, there is disclosed a construction permitting positioning of the ink-jet cartridge per se and establishing contact of the signal transmitting portion, simultaneously in one action, by utilizing engagement between a pair of the ink-jet cartridge in the vicinity of the recording head and a part of carriage, serving as a fulcrum.

However, in the construction where positioning of the ink-jet cartridge and establishing contact of the signal transmitting portion are performed simultaneously, it is possible to make the contact at the signal transmitting portion insufficient due to restriction by the positioning of the ink-jet cartridge, or vice-versa. Therefore, quite high accuracy in positioning of both is required.

Therefore, there has also been proposed a construction to perform positioning of the ink-jet cartridge and establishing of contact of the signal transmitting portion separately. However, at the position where both of the ink-jet cartridge and the signal transmitting portion are positioned, the acting forces may interface to each other to cause degradation of reliability particularly on the contact of the signal transmitting portion.

Solution for the problems set forth above has been proposed in U.S. Pat. No. 5,138,342. In the disclosed invention, when the positioning of the ink-jet cartridge is to be performed following establishing of contact of the signal transmitting portion, a supporting condition of the signal transmitting portion at the apparatus side is made free with maintaining contact condition at the signal transmitting portion to prevent mutual interface of the acting force to be exerted for positioning of the ink-jet cartridge.

As set forth above, the foregoing positioning structure is applied for the ink-jet cartridge, in which the recording head and the ink tank are integrated. However, in recent years, there has been proposed a construction to make the ink tank exchangeable with respect to the recording head. In the cartridge which permits exchanging of the ink tank with respect to the recording head, a force may act on the recording head which is positioned and fixed in place upon removal and/or installation of the ink tank during exchanging operation. The force generated upon exchanging of the ink tank may affect the position of the recording head and/or the contacting condition of the signal transmitting portion to potentially cause degradation of printing performance.

SUMMARY OF THE INVENTION

It is an object of the present invention to provide a mounting structure which can avoid influence of the force for a positioning of a recording head and/or contacting condition of a signal transmitting portion upon exchanging operation of an ink tank.

Another object of the invention is to provide a mounting structure which permits exchanging operation of the ink tank to be performed easily and certainly by avoiding influence of the force for a positioning of a recording head and/or contacting condition of a signal transmitting portion upon exchanging operation of an ink tank.

A further object of the invention is to provide an ink-jet recording apparatus which can achieve high precision in positioning and thereby permit formation of a high quality image.

According to one aspect of the present invention, an ink-jet recording apparatus having a carriage detachably mounting a recording head for recording input image information on a recording medium by ejecting ink through an ejection orifice and an ink tank for supplying the ink to the recording head and a main body portion including a drive mechanism for driving the recording head and the carriage, comprises:

a positioning device for positioning the recording head on the carriage; and an electrical connecting device for electrically connecting the recording head and the main body portion, the positioning device and the electrically connecting device being provided on the carriage independently of each other.

According to another aspect of the invention, an information processing system having an input device, a processing device for processing information input by the input device, and an output device for outputting information processed by the processing device, comprises:

a carriage detachably mounting a recording head for recording input image information on a recording medium by ejecting ink through an ejection orifice and an ink tank for supplying the ink to the recording head and a main body portion including drive means for driving the recording head and the carriage;

a positioning device for positioning the recording head on the carriage; and an electrical connecting device for electrically connecting the recording head and the main body portion, the positioning device and the electrical connecting device being provided on the carriage independently of each other.

The above and other objects, effects, features and advantages of the present invention will become more apparent from the following description of embodiments thereof taken in conjunction with the accompanying drawings.

BRIEF DESCRIPTION OF THE DRAWING

The present invention will be Understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The preferred embodiment of an ink-jet recording apparatus according to the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
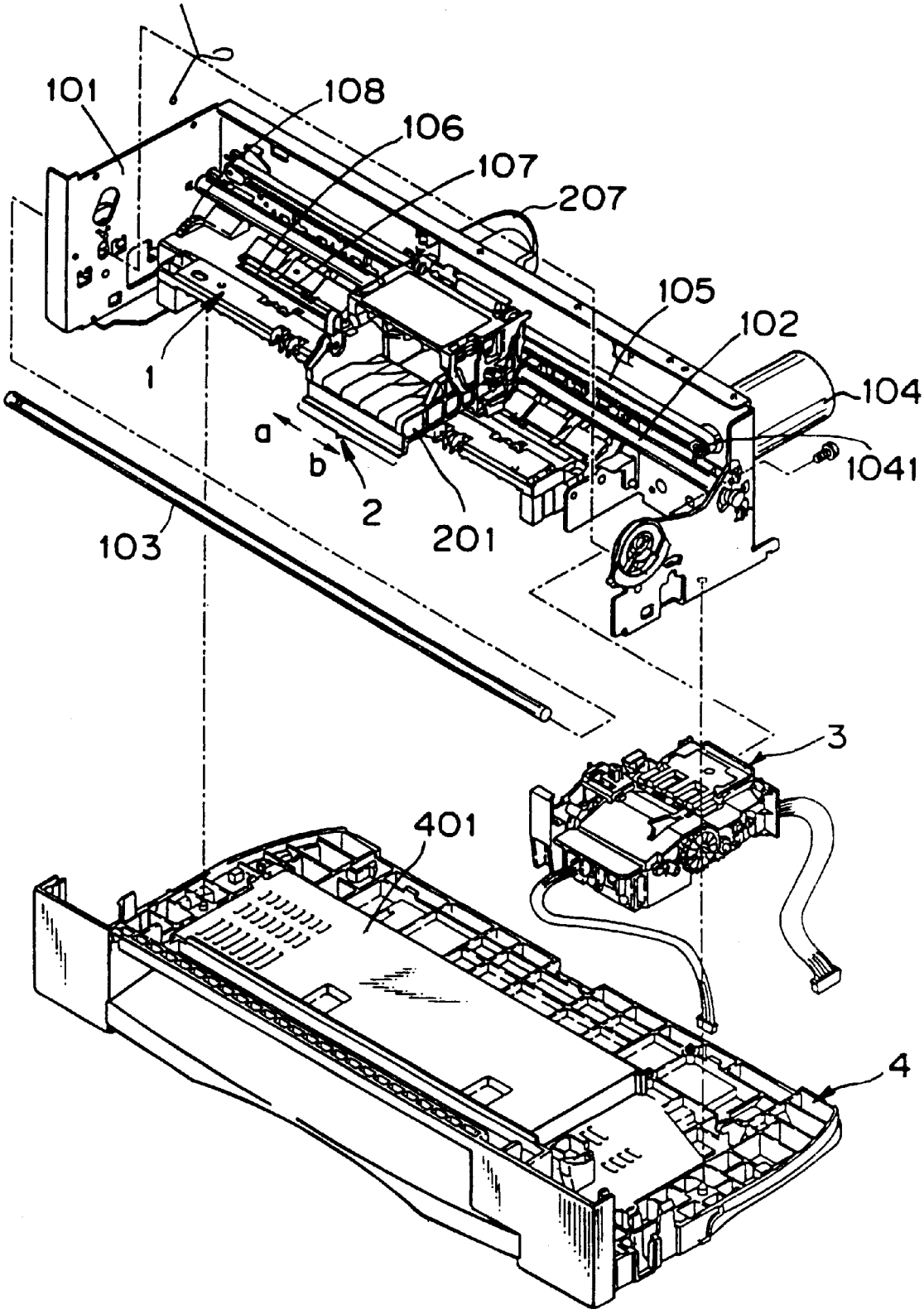
FIG. 1 is a perspective view of the preferred embodiment of an ink-jet recording apparatus of the present invention.

FIG. 1 is a perspective view showing the construction of the preferred embodiment of an ink-jet recording apparatus according to the present invention. The ink-jet recording apparatus includes a paper feeder portion 1, a carriage portion 2, a purge portion 3, and a casing portion 4 supporting a printer portion constituted of the paper feeder portion, the cartridge portion and the purge portion.

As shown in FIG. 1, the paper feeder portion 1 includes a platen roller 106, onto which a pinch roller 107 is depressed for feeding a recording medium. The platen roller 106 is driven by a transporting motor (not shown) via a transmission mechanism constituted of a transporting roller gear 108 and a transporting roller idler gear (not shown).

As shown in FIG. 1, the carriage portion 2 includes a carriage base 201 supported for movement along a guide shaft 102 and a support shaft 103. The carriage base 201 is held for preventing rotation. Associated with revolution in forward or reverse direction of a carriage motor 104, a pulley 1041 rotates to move a timing belt 105 fixed to the carriage portion 2 in a direction shown by arrow a or b. As a result, the carriage portion 2 is reciprocally driven in the directions of the arrows a and b. On the other hand, by means of a HP sensor (not shown) secured on a chassis 101, the carriage portion 2 is certainly placed at a predetermined position (for example, home position) in non-recording state and so forth.

Figure 4:
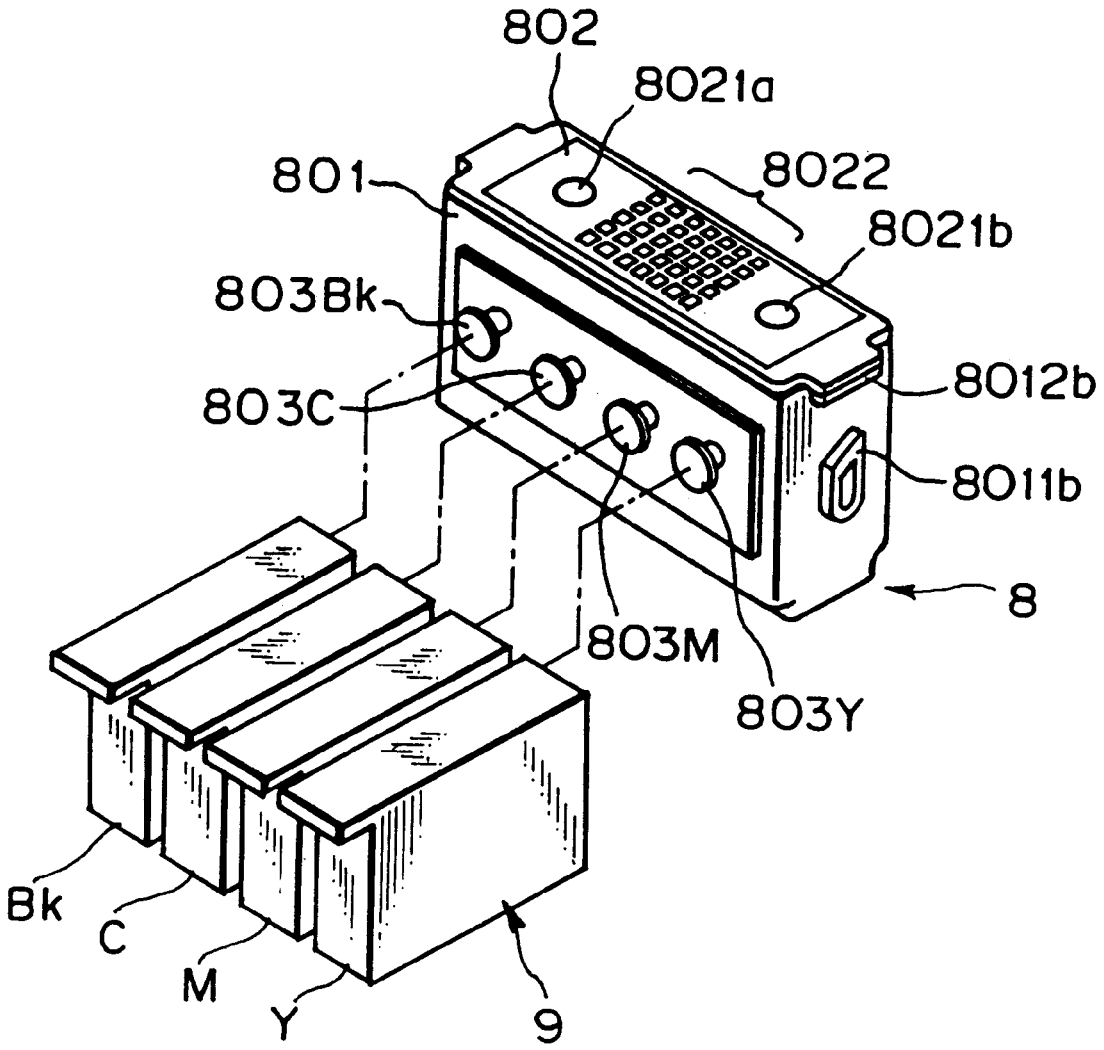
FIG. 4 is an explanatory perspective view showing the carriage portion shown in FIG. 2.

As shown in FIG. 4, the purge portion 3 is a unit for recovering operation by sucking ink from the recording head 8 when the recording head 8 is blocked by foreign matter, such as dust or so forth and becomes impossible to eject ink.

The casing portion 4 is adapted to support the printer portion. The casing portion 4 has a disposed ink tank 401 for accumulating disposed ink sucked by the purge portion 3.

In FIG. 4, the reference numeral 8 denotes a recording head unit. In the shown embodiment, the recording head unit 8 includes four ink-jet recording heads in integral fashion for mainly performing color printing. The recording head unit 8 is adapted to be detachably mounted on the carriage so that it may be replaced with new recording head unit 8 when the lift of the ink-jet recording head is end or failure is caused in some reason.

In FIG. 4, the reference numeral 9 denotes an ink tank for supplying respectively corresponding ink to the four ink-jet recording heads in the recording head unit 8. The ink tanks 9 are detachably mounted on an ink supply portion 803 provided in the recording head unit 8. In the shown embodiment of the ink-jet recording apparatus, the carriage portion 2 carrying the recording head unit 8 and the ink tanks 9, is coupled with a part of the timing belt 5 transmitting a driving force of the carriage motor 104, and mounted on mutually parallel guide shaft 102 and the support shaft 103 for sliding movement therealong. By the driving force of the carriage portion 2, the recording head unit 8 reciprocally travels through entire width of a recording paper (recording medium) supplied from a not shown medium feeder device.

<Construction of Carriage>

Next, discussion will be given for the construction of the carriage portion 2 employed in the shown embodiment.

Figure 2:
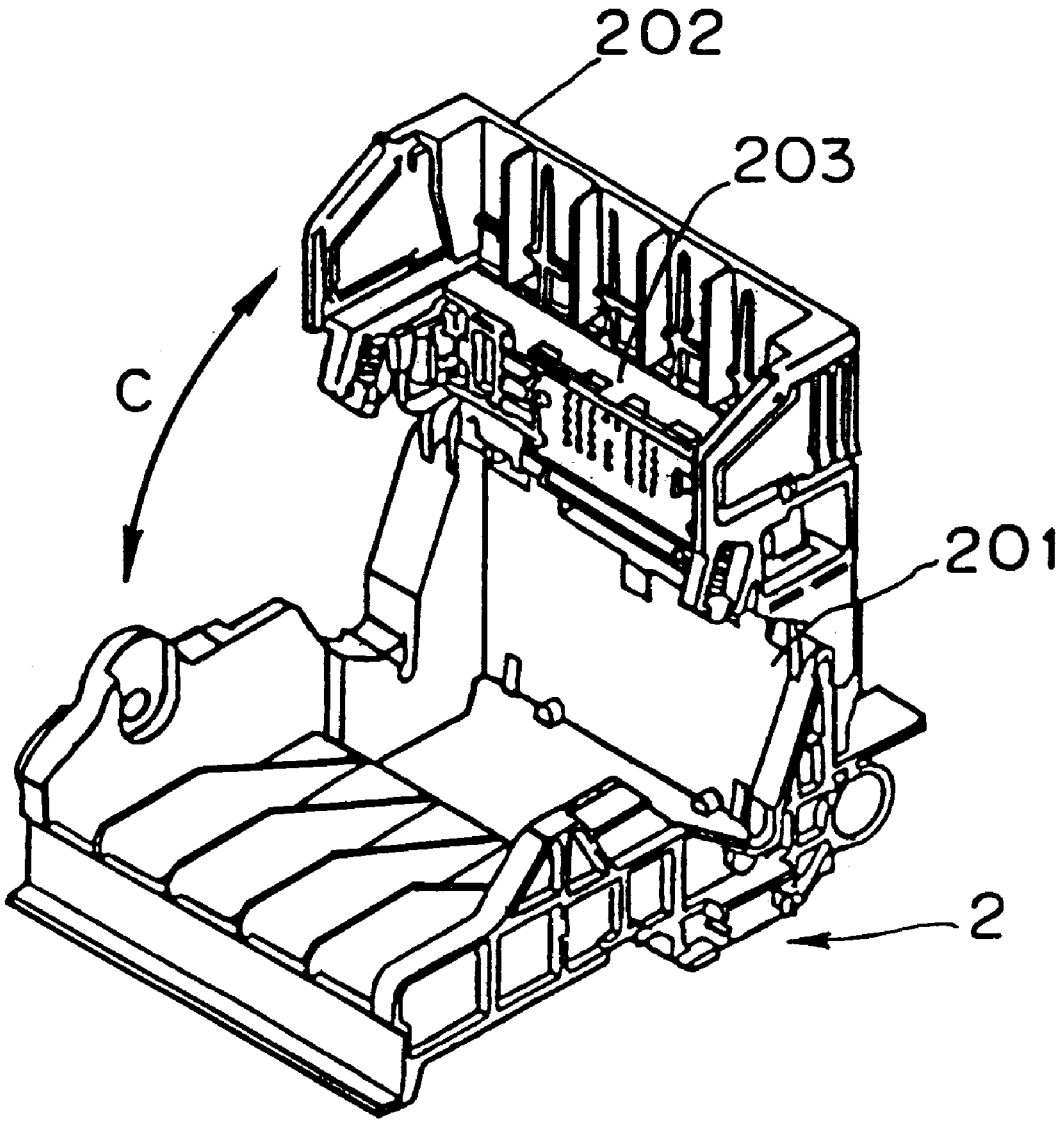
FIG. 2 is a perspective view of a carriage portion employed in the recording apparatus illustrated in FIG. 1.

As shown in FIG. 2, the carriage portion 2 comprises the carriage base 201, a head lever 202 and an FPC holder 203. The carriage base 201 is of substantially box-shaped configuration with a bottom portion so that the recording head unit and the ink tanks may arrange therein. The head lever 202 and the FPC holder 203 are pivotally engaged to the carriage base 201 at one end, the detail of which will be discussed with respect to FIGS. 3 and 10, later. The head lever 202 is adapted to over the opening portion of the carriage base 201 by pivoting as shown by arrow c. In the shown embodiment, as shown in FIG. 4, the recording head unit 8 is constituted of four integrated recording heads for ejecting inks of black (Bk), cyan (C), magenta (M) and yellow (Y) and mounts four ink tanks 9 supplying inks of black, cyan, magenta and yellow to respectively corresponding recording heads.

<Positioning Device>

The recording head unit S is arranged at the predetermined position on the carriage base 201 and depressed by the head lever 202 to be held at both ends and thus to be positioned at the predetermined position.

Figure 3:
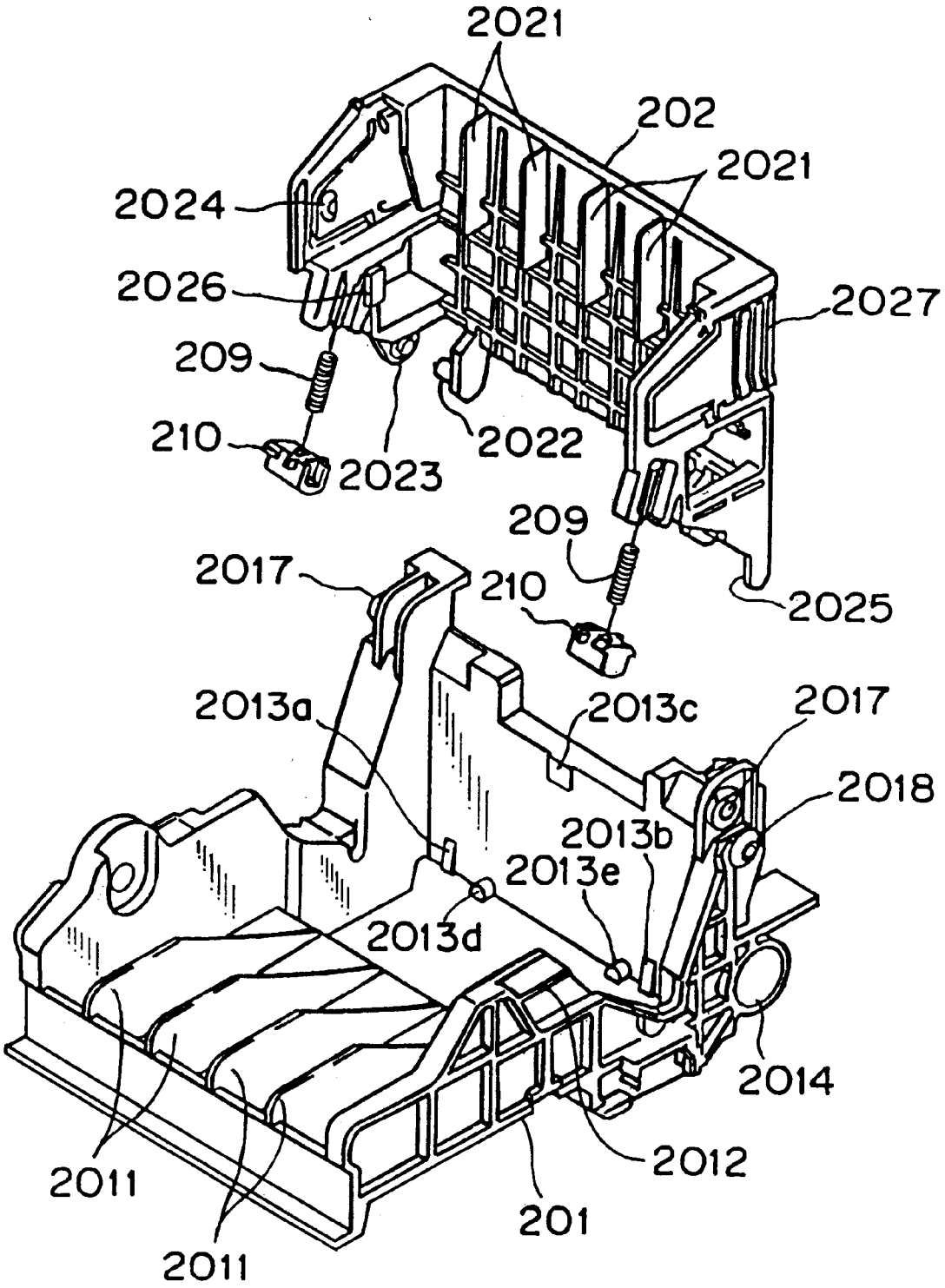
FIG. 3 is a perspective view of a recording head portion and an ink tank to be installed in the carriage portion shown in FIG. 2.
Figure 7:
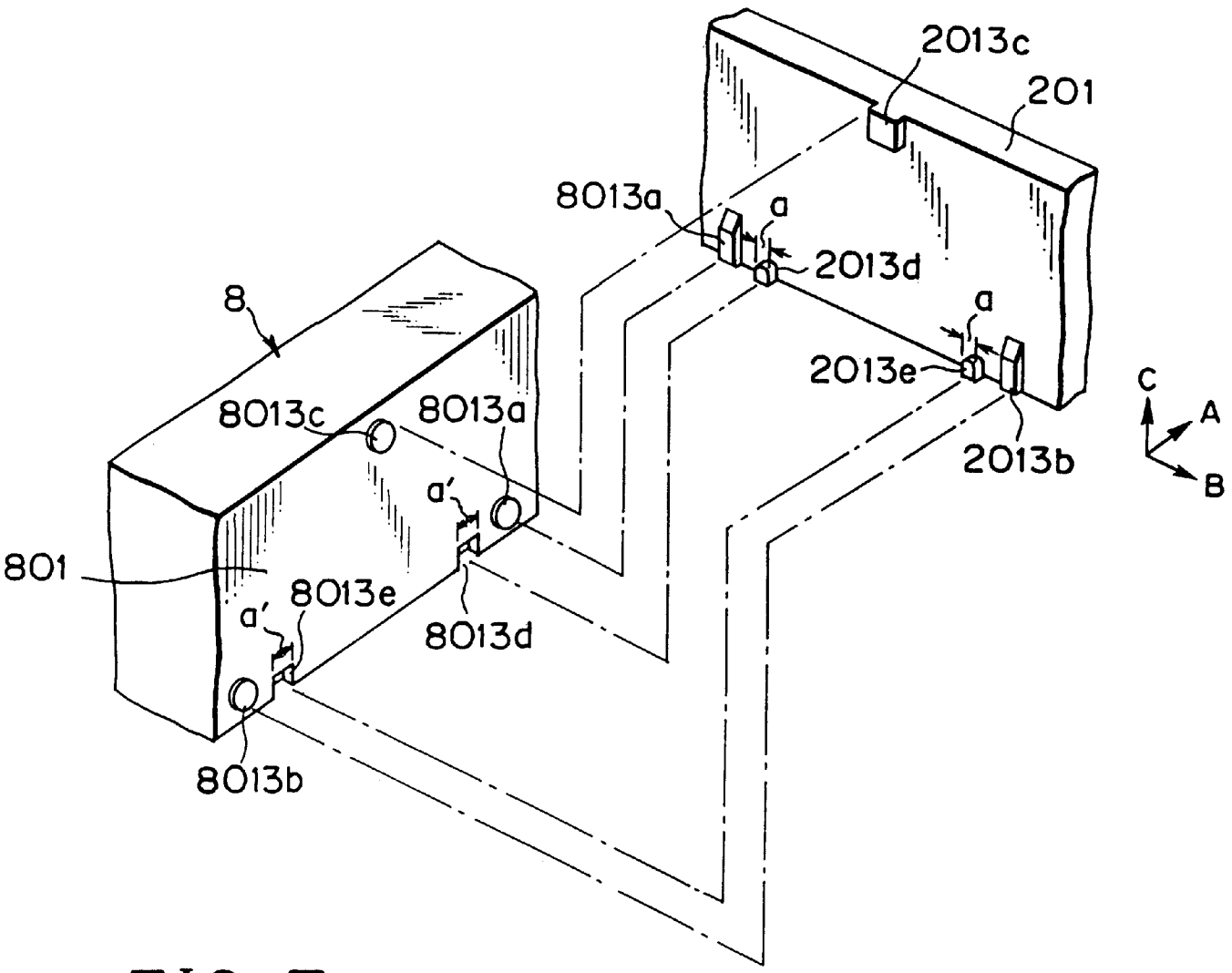
FIG. 7 is an explanatory perspective view diagrammatically illustrating the construction of members associated with positioning of the recording head portion with respect to the carriage portion.

In the shown embodiment, as shown in FIG. 3 or 7, five bosses 201*a* to 201*e* for positioning the recording head unit 8 on the carriage base 201 are illustrated. In FIG. 7, in order to show the direction of positioning, arrows A, B and C which are directed in perpendicular directions to each other. Positioning in the direction of arrow B is performed by engaging bosses (projecting portions) 2013*d* and 2013*e* (width a) and recess portions (recessed portion) 8011*d* and 8011*e* of the head base 801 (width a'). Positioning in the direction of arrow A is performed by abutting bosses 2013*a*, 2013*b* and 2013*c* on the carriage base 291 with bosses 8011*a*, 8011*b* and 8011*c* on the head base. Positioning in the direction of arrow C is performed by abutting bosses 2013*d* and 2013*e* on the carriage 201 and the recess portions 8011*d* and 8011*e* on the head base 801.

As shown in FIG. 3, the head lever shafts 2023 of the head lever 202 engages with head lever bearing portions 2017, 2017 of the carriage base 201 for permitting pivotal movement of the head lever 202. On the other hand, in order to open the head lever 202 for facilitating installation and removal of the recording head unit 8, the head lever positioning boss 2025 for positioning and securing the head lever 202 at the open position is engaged to the head lever positioning hole 2018 of the carriage base 201.

At left side and right side of the head lever 202, head tension springs 209 are installed. Also, head tensions 210 are installed at both lateral sides of the head lever 202. The head tensions 210 are engaged to the head lever 202 so as not to loose away.

Figure 8:
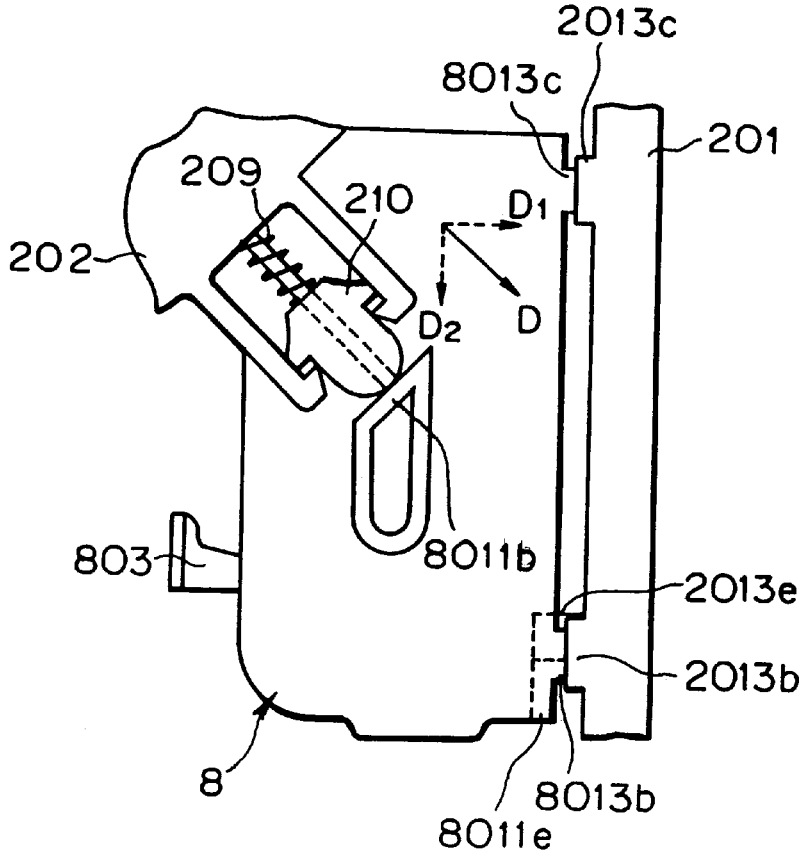
FIG. 8 is an explanatory section diagrammatically illustrating construction of the carriage portion, the recording head portion and a recording head fixing member.

By installing the recording head unit 8 on the carriage base 201 and pivoting the head lever 202, the head tensions 210 depresses a tapered portion of a head tension receptacle 8012 as shown in FIG. 8 to position the recording head unit 8 and the carriage base 201 at a relationship illustrated in FIG. 7. On the other hand, to head lever fixing portions 2012 of the carriage base 201, engaging portions 2024 of the head lever 202 are engaged to fix the head lever. When the head lever 202 is released from the carriage base 201, a head release portion 2027 is depressed to displace the head lever fixing bosses 2024 outwardly away from the head lever fixing portions 2012. Then, the head lever 202 is permitted pivotal movement relative to the carriage base 201. In FIG. 3, carriage ink tank guide rib portions 2011 on the carriage base 201 and carriage ink tank guide rib portions 2021 of the head lever 202 are provided respectively for serving as guides for installation of ink tanks 9 on the carriage portion 2.

<Electrical Connection Device>

Figure 5:
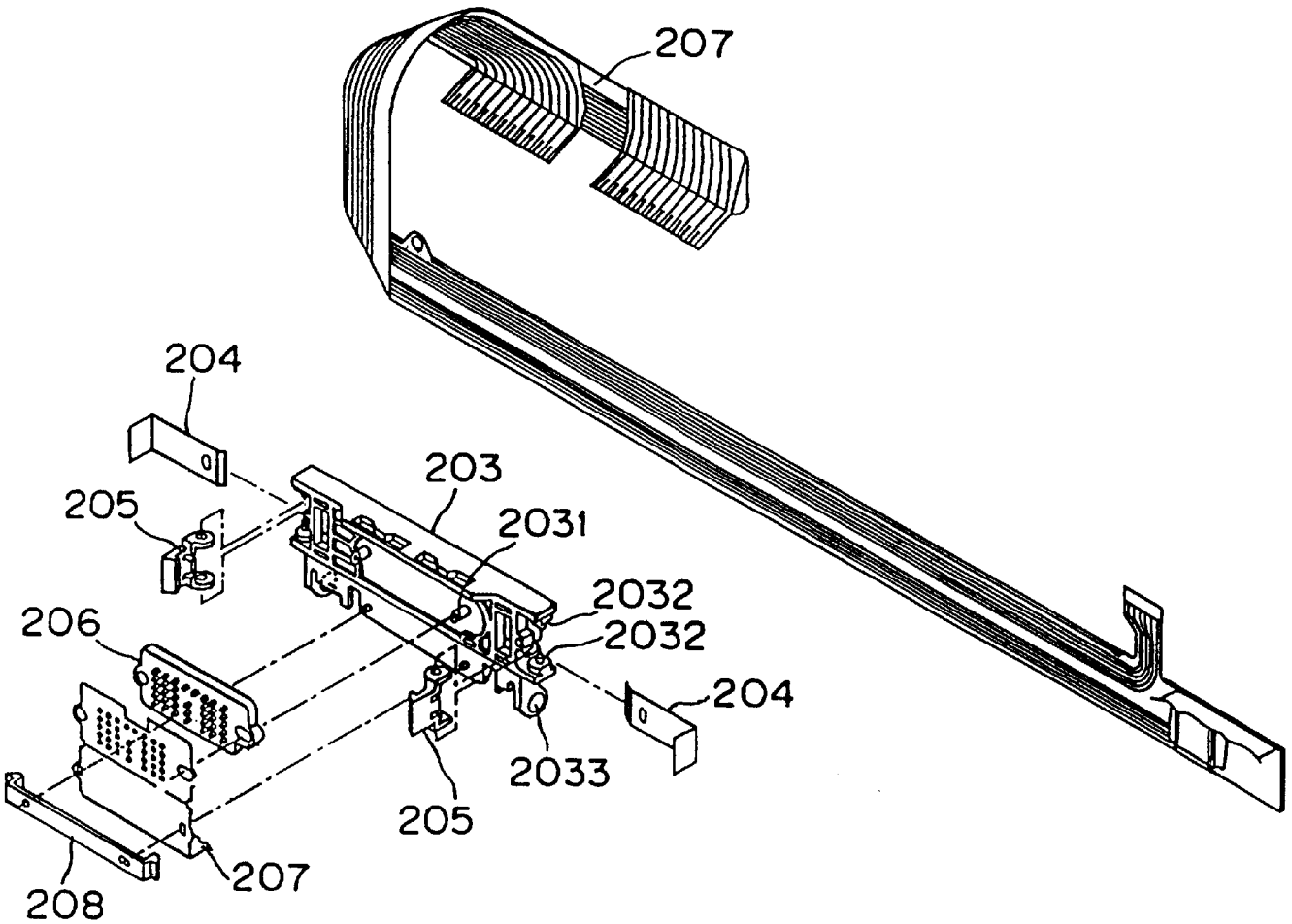
FIG. 5 is a perspective view showing a construction carriage flexible cable electrically connected to the recording head portion via the carriage portion and a device for connection.

As shown in FIG. 5, a carriage flexible cable 207 is designed for supplying an image signal and a drive signal to the recording head unit 8. The carriage flexible cable 207 is mounted on the head lever 202 of the carriage portion via the FPC holder 203. Contact positioning bosses 2032*b* of the FPC: holder 203 position the carriage flexible cable 207 on the FPC holder 203 via a rubber pad 206. Furthermore, the carriage flexible cable 207 is snap fitted onto the FPC holder 203 by means of a FPC retainer 208. At the longitudinal both ends of the FPC holder 203, head hooks 205 are pivotally provided. These head hooks 205 engage with shafts 2032 for pivoting thereabout. On the other hand, the head hooks 205 are biased inwardly by FPC spring 204 and thus fixed at the predetermined position by not shown stopper portions of the FPC holder 203. The FPC holder 203 has FPC holder bearing portion 2033 shown in FIG. 10 engaged with a FPC holder shaft 2022 of the head lever 202 for pivoting thereabout. An opening of the FPC holder bearing portion 2033 is formed to be greater relative to the holder shaft 2022 to have a sufficient play in the engaged condition. The image signal and the drive signal supplied from the carriage flexible cable 207 is supplied to the ink-jet recording unit 8 from a contact portion 8022 of a contact portion 8022 shown in FIG. 4 to perform ink-jet printing.

The carriage portion 2 constructed as set forth above is fixed to the timing belt 105. The timing belt 105 is set on a belt stopper 211 which is, in turn, secured on the carriage base 201. The carriage flexible cable 207 is fixed to the carriage base 201 by a carriage PCB 213 and CRPCB covrer 214. A linear encoder 212 serves as a sensor for controlling position of the carriage 2 and is secured on the carriage base 201.

Figure 6:
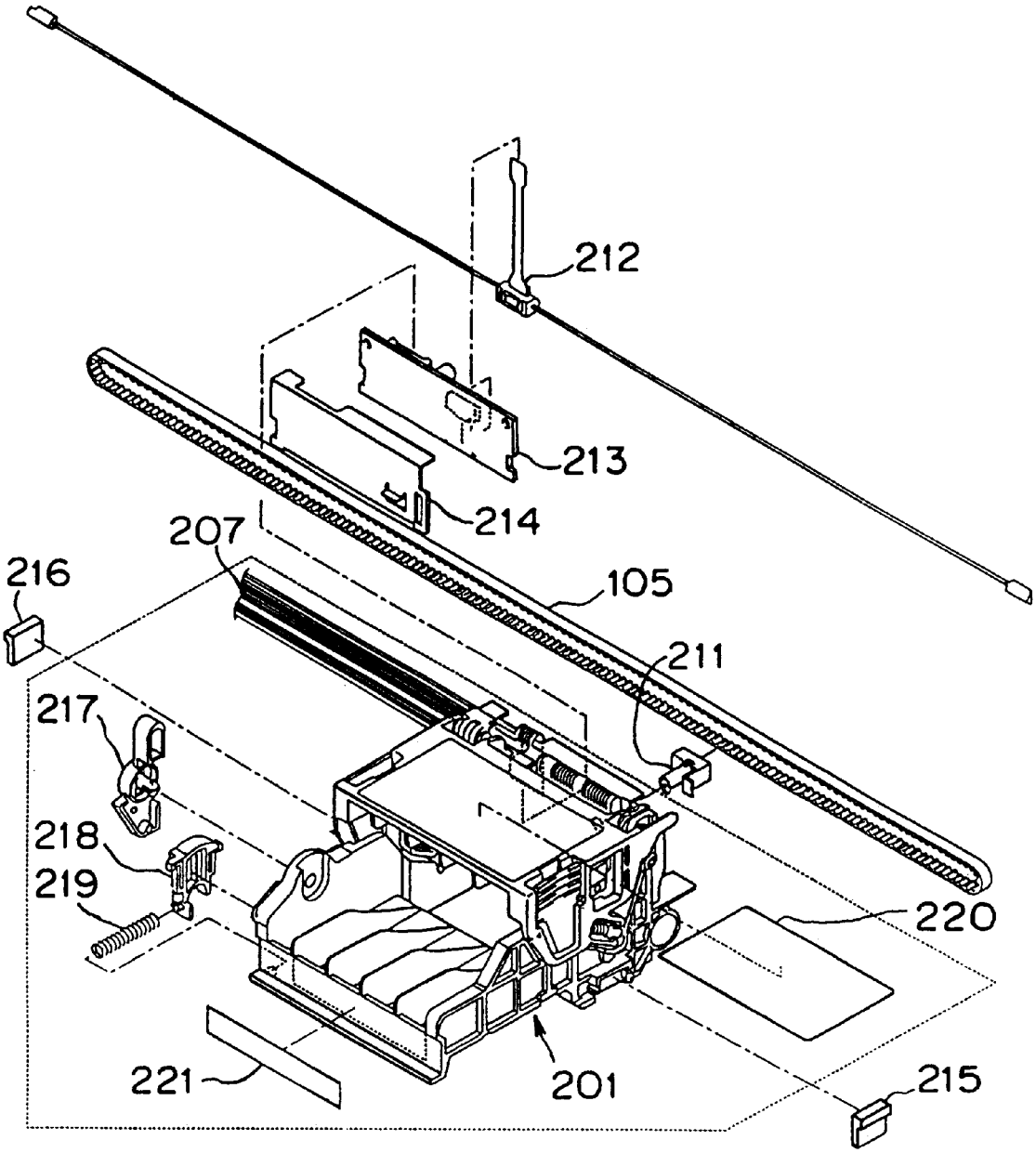
FIG. 6 is a perspective view of the carriage portion shown in FIG. 2 and a timing belt driving the carriage.

A head lever label 220 showing manner of installation of the recording head unit 8, the ink tanks 9 to the carriage portion is stuck on the head lever 202 as shown in FIG. 6. Alternatively, it may be possible to punch the operation manner in the head lever 202.

<Connection of Recording head Unit and Carriage Flexible Cable>

Figure 9:
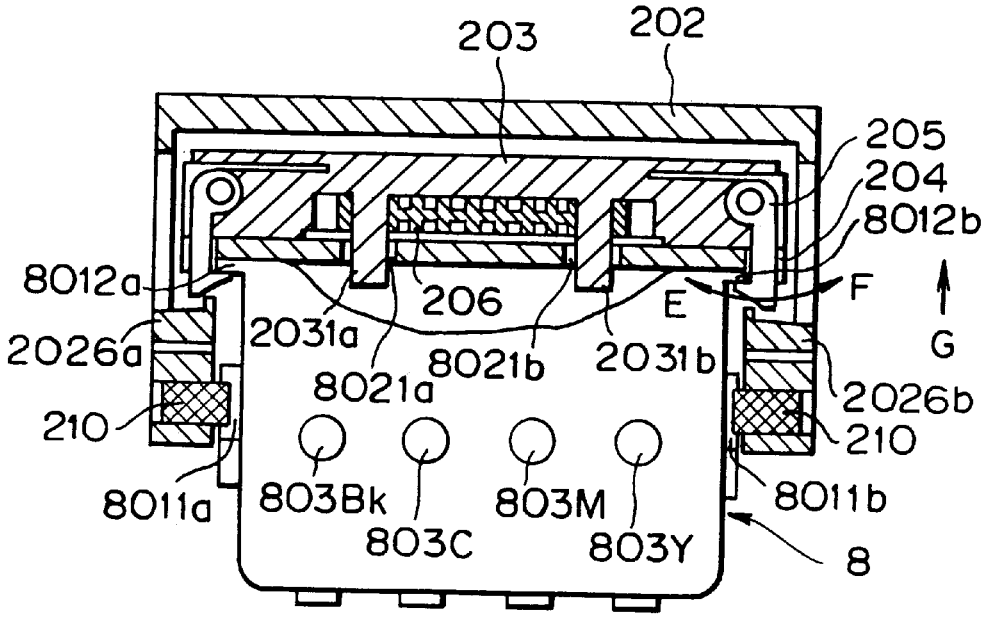
FIG. 9 is an explanatory section diagrammatically illustrating the construction of the recording head portion and the recording head fixing device.

FIG. 9 is a section showing a condition where the recording head unit 8 and the carriage flexible cable 207 are connected.

By pivoting the head lever 202 in closing direction, the FPC holder 203 pivots in the closing direction, simultaneously. During pivotal motion, a pair of contact positioning bosses 2031*a* and 2031*b* of the FPC holder 2092 engages with contact positioning holes 8021*a* and 8021*b* respectively to achieve positioning. By further pivotal movement of the head lever 202, the head hook 205 engages with a head hook receptacle portion 8012 provided in the recording head unit 8 to establish the condition illustrated in FIG. 9.

It should be noted that the contact positioning bosses 2031*a* and 2031*b* also serve for positioning of rubber pads 206 and carriage flexible cable 207. At the condition where positioning is achieved, the rubber pads 206 are crushed so that electrical connection between the carriage flexible cable and the recording head unit 8 can be established by depressing the carriage flexible cable 207. For releasing from the installed condition, the head lever 202 is pivoted in the opposite direction. Then, release claws 2026*a* and 2026*b* of the head lever 202 causes pivotal motion in the arrow F of the head hooks 205 to release away from the head hook receptacle portions 8012*a* and 8012*b*. Also, by disconnecting the contacts of the carriage flexible cable 207 and the recording head unit 8, the power source supplied from the main body portion to the recording head unit is shut off.

As shown in FIG. 9, in the state where the recording head unit 8 is installed, the carriage flexible cable 207 is depressed onto the contact 8022 provided on the upper surface of the recording head unit 8, and accurately positioned by contact positioning bosses 2031*a* and 2031*b*. The FPC holder 203 forms integrated engagement with the recording head unit 8 by engaging the head hook 205 to the head hook receptacle portion 8012 of the recording head unit 8.

Figure 10:
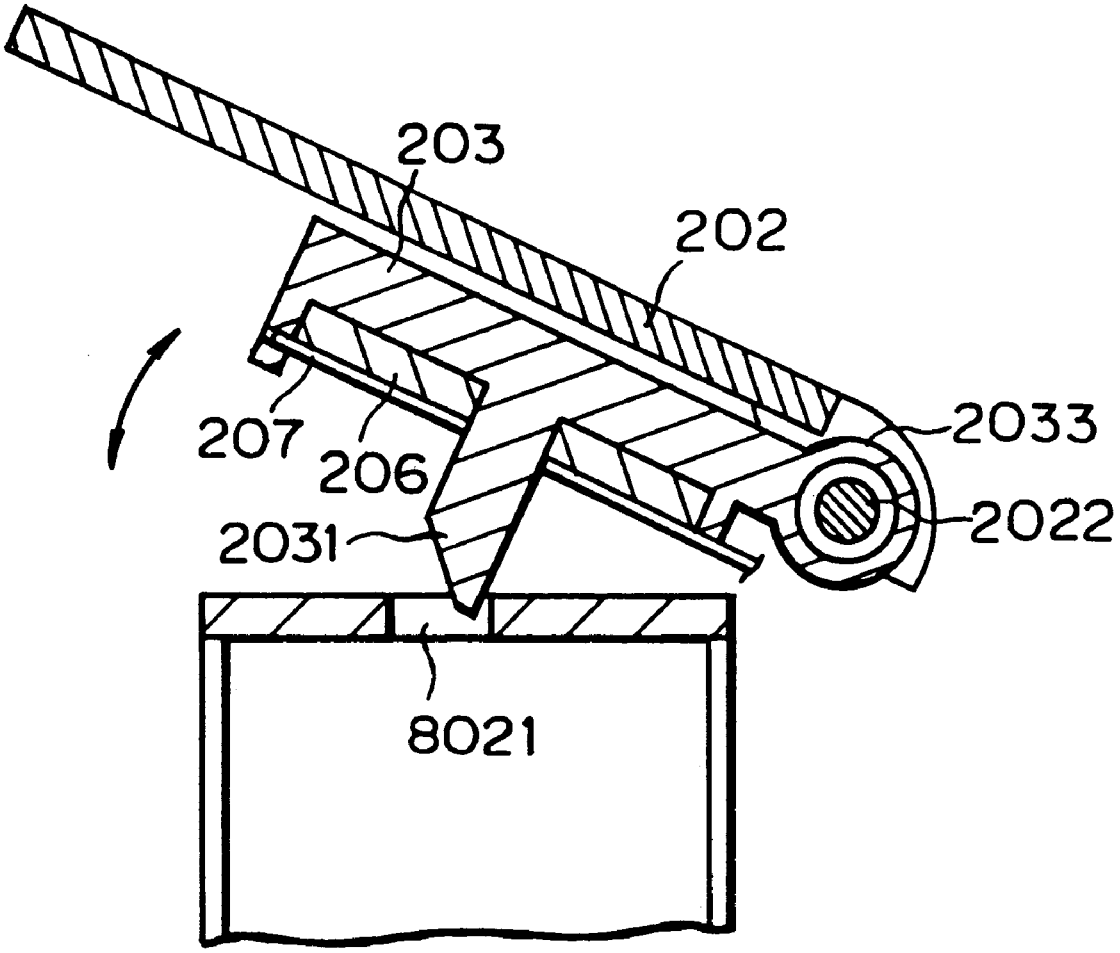
FIG. 10 is an explanatory section diagrammatically illustrating the construction of the recording head and the recording head fixing member upon operation.

On the other hand, the FPC holder bearing portion 2033 of the FPC holder 203 is constructed to have greater diameter than the diameter of the holder shaft 2022, as shown in FIG. 10. Therefore, the FPC holder 203 is mounted on the holder shaft 2022 with a play.

Then, by further pivoting the head lever in the closing direction, the tapered position of the head tension receptacle portion 8012 provided at both sides of the recording head unit 8 is resiliently depressed onto the head tension 204 provided on the head lever 202 to achieve positioning of the recording head unit 8 with respect to the carriage base 201, as shown in FIG. 7 or 8.

As set forth above, the recording head unit 8, for which electrical connection is completed, can be positioned on the carriage base 201 with maintaining an appropriate play. Therefore, electrical connection and positioning of the recording head unit 8 can be performed completely independent of each other so that the recording head unit can be positioned without any influence of the force for establishing the electrical connection.

Accordingly, as shown in FIG. 4, even when the force for detaching and attaching the ink tanks 9 to the recording head unit 8 is exerted on the recording head unit, since the recording head unit is resiliently positioned by the head tension 210 to cause slight movement by the force, it can be restored at the predetermined position after completion of detaching and attaching operation of the ink tanks 9. Furthermore, since the electrical connecting portion is fixed independent of the positioning of the recording head unit 8, the force generated in detaching and attaching the ink tanks 9 will never affect the electrical connecting portion.

Therefore, even when detaching and attaching of the ink tanks 9 is performed repeatedly, the recording head unit 8 can be stably maintained at the predetermined position. Also, since the electrical connecting portion is not subjected to the force, electrical connection can be maintained in quite stable condition. Therefore, it becomes possible to provide the ink-jet recording apparatus having the construction of the installing portion achieving high accuracy positioning and high quality image formation.

FIG. 10 is a section showing an engaging condition between the recording head unit 8 and the FPC holder 203.

The FPC holder bearing portion 203 of the FPC holder 203 and the FPC holder shaft 2022 of the head lever 202 are pivotally engaged with maintaining a certain play. The contact positioning boss 2031 of the FPC holder 203 is in a configuration cutting a cylindrical shape along an oblique plane as shown, it may engage the contact positioning holes 8021. The FPC holder 203 is formed as a separate member to the head lever 202 and coupled with a play as set forth above. Therefore, even when the recording head unit 8 is electrically connected to the main body portion, it may not interfere positioning of the recording head unit 8 on the carriage base 201.

<Installation of Ink Tank>

Figure 11:
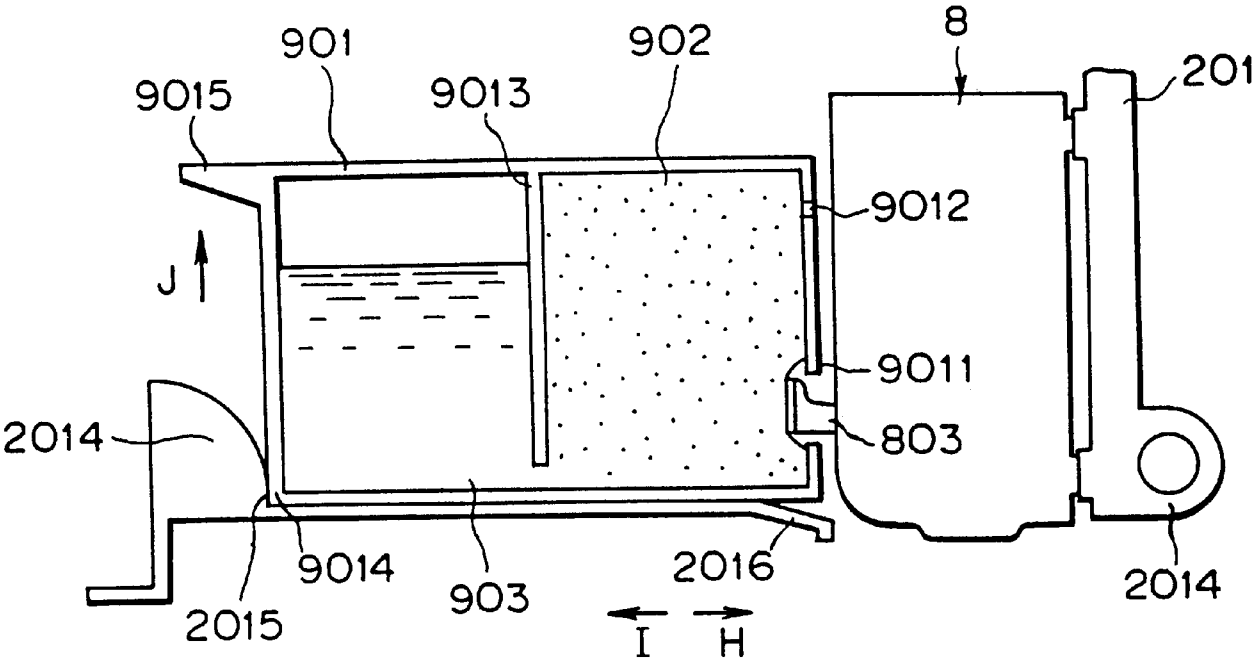
FIG. 11 is a sectional side elevation of the carriage portion arranged with connection between the recording head and the ink tank.

FIG. 11 is a section showing a condition where the recording head unit 8 and the ink tanks 9 are installed on the carriage portion 2.

Figure 12:
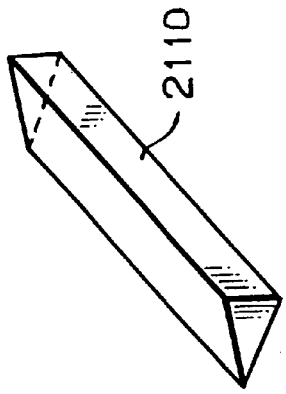
FIG. 12 is a perspective view of an absorbing body.

The ink tank 901 is of the type including an absorbing body 902 and a raw ink and adapted to supply ink to the ink-jet recording head of the recording head unit 8. When the ink tank is installed on the recording head unit 8, the ink supply portion 803 of the recording head unit 8 squeeze he absorbing body 902 to depress the ink tank 901 in the direction shown by arrow I. Then, the ink tank 901 is fixed by a stopper 2015 of the carriage base 201. The ink tank 9 can be smoothly installed in the recording head unit 8 in the aid of a guide portion 204 of the carriage base 201. Upon removal of the ink tank 901, the ink tank can be detached by pushing up a handle 9015 in the direction shown by the arrow J. Disposed ink from the ink supply portion 803 of the recording head unit 8 and the supply opening 9011 of the ink tank 901 is supplied to the purge unit 3 at the lower portion by an ink disposing portion 2016. Also, it is possible to provide an absorbing body 2110 as illustrated in FIG. 12.

What is claimed is:

1. An ink-jet recording apparatus for recording input image information on a recording medium by ejecting ink, comprising:

a carriage for mounting an ink-jet recording head, said carriage having a positioning portion for positioning said ink-jet recording head;

an electrical connecting device for electrically connecting to an electrical connecting portion provided on said ink-jet recording head, said electrical connecting device having an engaging portion for engaging and electrically connecting with said electrical connecting portion of said ink-jet recording head; and a head-positioning device having pressing means for elastically pressing said ink-jet recording head to said positioning portion of said carriage and supporting means for supporting said electrical connecting device so as to allow displacement of said electrical connecting device relative to said carriage, wherein said head-positioning device positions said ink-jet recording head so as to allow relative displacement of said ink-jet recording head with respect to said carriage, and said positioning device supports said ink-jet recording head and said electrical connecting device which are integrally engaged with each other so as to allow displacement thereof with respect to said head-positioning device.

2. An ink jet recording apparatus as claimed in claim 1, wherein said positioning device detachably fixes said recording head on said carriage by depressing a predetermined portion of said recording head.

3. An ink-jet recording apparatus as claimed in claim 2, wherein said electrical connecting device is detachably fixed to said recording head.

4. An ink-jet recording apparatus as claimed in claim 1, wherein said electrical connecting device establishes an electrical connection with said electrical connecting portion in association with a positioning operation for said recording head on said carriage by said positioning device.

5. An ink-jet recording apparatus as claimed in claim 1, wherein said recording head is resiliently positioned on said carriage.

6. An ink-jet recording apparatus as claimed in claim 1, wherein an ink tank supplies the ink to said recording head and said ink tank incorporates an absorbing body and is fixed to said carriage using said absorbing body.

7. An ink-jet recording apparatus as claimed in claim 1, wherein an ink tank supplies the ink to said recording head and said carriage is provided with a tapered portion near a coupling portion between said recording head and said ink tank.

8. An ink-jet recording apparatus as claimed in claim 7, wherein an absorbing body is provided in said tapered portion.

9. An ink-jet recording apparatus as claimed in claim 1, wherein an ink tank supplies the ink to said recording head and said positioning device is provided with a guide portion for said ink tank.

10. An ink-jet recording apparatus as claimed in claim 1, wherein an ink tank supplies the ink to said recording head and said positioning device is provided with a display portion showing a manner of installation of said recording head and said ink tank on said carriage.

11. An ink-jet recording apparatus as claimed in claim 1, wherein said recording head comprises an electrothermal transducer ejecting ink droplets through an ejection orifice utilizing nucleate boiling caused in the ink by thermal energy, as means for generating energy for ejecting the ink.

12. An ink-jet recording apparatus according to claim 1, wherein said ink-jet recording head comprises an electrothermal converting element for generating thermal energy to cause the ink to be discharged from an ink ejection orifice.

13. A recording apparatus for recording input image information on a recording medium, comprising:

a carriage for mounting a recording head, said carriage having a positioning portion for positioning said recording head;

an electrical connecting device for electrically connecting to an electrical connecting portion provided on said recording head, said electrical connecting device having an engaging portion for engaging and electrically connecting with said electrical connecting portion of said recording head; and a head-positioning device having pressing means for elastically pressing said recording head to said positioning portion of said carriage and supporting means for supporting said electrical connecting device so as to allow displacement of said electrical connecting device relative to said carriage, wherein said head-positioning device positions said recording head so as to allow relative displacement of said recording head with respect to said carriage, and said positioning device supports said recording head and said electrical connecting device which are integrally engaged with each other so as to allow displacement thereof with respect to said head-positioning device.

14. A recording apparatus as claimed in claim 13, wherein said positioning device detachably fixes said recording head on said carriage by depressing a predetermined portion of said recording head.

15. A recording apparatus as claimed in claim 14, wherein said electrical connecting device is detachably fixed at the predetermined portion of said recording head.

16. A recording apparatus as claimed in claim 13, wherein said electrical connecting device establishes an electrical connection with said electrical connecting portion associated with a positioning operation for said recording head on said carriage by said positioning device.

17. A recording apparatus as claimed in claim 13, wherein said recording head is resiliently positioned on said carriage.

18. A recording apparatus as claimed in claim 13, wherein an ink tank supplies ink to said recording head and said ink tank incorporates an absorbing body and is fixed to said carriage using said absorbing body.

19. A recording apparatus as claimed in claim 13, wherein an ink tank supplies ink to said recording head and said carriage is provided with a tapered portion near a coupling portion between said recording head and said ink tank.

20. A recording apparatus as claimed in claim 19, wherein an absorbing body is provided in said tapered portion.

21. A recording apparatus as claimed in claim 13, wherein an ink tank supplies ink to said recording head and said positioning device is provided with a guide portion for said ink tank.

22. A recording apparatus as claimed in claim 13, wherein an ink tank supplies ink to said recording head and said positioning device is provided with a display portion showing a manner of installation of said recording head and said ink tank on said carriage.

23. A method of mounting a recording head on a carriage, comprising the steps of:

providing a carriage for mounting a recording head, the carriage having a positioning portion for positioning the recording head;

providing an electrical connecting device for electrically connecting to an electrical connecting portion provided on the recording head, the electrical connecting device having an engaging portion for engaging and electrically connecting with the electrical connecting portion of the recording head;

providing a head-positioning device; and elastically pressing the recording head to the positioning portion of the carriage with the head-positioning device and supporting the electrical connecting device so as to allow displacement of the electrical connecting device relative to the carriage, the head-positioning device positioning the recording head so as to allow relative displacement of the recording head with respect to the carriage, and supporting the recording head and the electrical connecting device which are integrally engaged with each other so as to allow displacement thereof with respect to the head-positioning device.

24. A method as claimed in claim 23, wherein the positioning device detachably fixes the recording head on the carriage by depressing a predetermined portion of the recording head.

25. A method as claimed in claim 24, wherein the electrical connecting device is detachably fixed at the predetermined portion of the recording head.

26. A method as claimed in claim 23, wherein the electrical connecting device establishes an electrical connection with the electrical connecting portion associated with a positioning operation for the recording head on the carriage by the positioning device.

27. A method as claimed in claim 23, wherein the recording head is resiliently positioned on the carriage.

28. A method as claimed in claim 23, wherein an ink tank supplies ink to the recording head and the ink tank incorporates an absorbing body and is fixed to the carriage using the absorbing body.

29. A method as claimed in claim 23, wherein an ink tank supplies ink to the recording head and the carriage is provided with a tapered portion near a coupling portion between the recording head and the ink tank.

30. A method as claimed in claim 29, wherein an absorbing body is provided in the tapered portion.

31. A method as claimed in claim 23, wherein an ink tank supplies ink to the recording head and the positioning device is provided with a guide portion for the ink tank.

32. A method as claimed in claim 23, wherein an ink tank supplies ink to the recording head and the positioning device is provided with a display portion showing a manner of installation of the recording head and the ink tank on the carriage.

* * * * *

UNITED STATES PATENT AND TRADEMARK OFFICE

CERTIFICATE OF CORRECTION

PATENT NO. : 5,923,350 Page 1 of 3

DATED : July 13, 1999

INVENTOR(S) : OHNISHI ET AL.

It is certified that error appears in the above-identified patent and that said Letters Patent is hereby corrected as shown below:

ON THE TITLE PAGE:

Item [57] ABSTRACT:

Line 2, "postioning" should read --positioning--.

COLUMN 1:

Line 31, "viewpoint" should read --view--.
Line 33, "have" should read --has--.
Line 35, "irk" should read --ink--.
Line 44, "aha" should read --has--.
Line 49, "pair" should read --part--.

COLUMN 2:

Line 1, "Solution" should read --A solution--.

COLUMN 3:

Line 15, "Understood" should read --understood--.

COLUMN 4:

Line 1, "instance," should read --instances,--.
Line 2, "order to unnecessary" should read --order not to unnecessarily--.
Line 29, "FIG. 4," should read --FIG. 1,--.
Line 32, "impossible" should read --unable--.
Line 42, "lift" should read --life-- and "end" should read --at its end--.
Line 43, "in" should read --for--.
Line 66, "arrange" should read --be arranged--.

UNITED STATES PATENT AND TRADEMARK OFFICE

CERTIFICATE OF CORRECTION

PATENT NO. : 5,923,350

DATED : July 13, 1999

INVENTOR(S) : OHNISHI ET AL.

It is certified that error appears in the above-identified patent and that said Letters Patent is hereby corrected as shown below:

COLUMN 5:

Line 3, "over" should read --cover--.
Line 12, "S" should read --8--.
Line 17, "201a to 201e" should read --2013a to 2013e--.
Line 20, "which" should be deleted.
Line 32, "engages" should read --engage--.
Line 44, "loose away." should read --loosen.--.
Line 47, "depresses" should read --depress--.
Line 57, "pivotal movement" should read --to pivotally move--.

COLUMN 6:

Line 2, "FPC:" should read --FPC--.
Line 5, "the longitudinal both" should read --both longitudinal--.
Line 25, "covrer" should read --cover--.

COLUMN 7:

Line 57, "interfere" should read --interfere with--.
Line 67, "squeeze he" should read --squeezes the--.

UNITED STATES PATENT AND TRADEMARK OFFICE

CERTIFICATE OF CORRECTION

PATENT NO. : 5,923,350 Page 3 of 3

DATED : July 13, 1999

INVENTOR(S) : OHNISHI ET AL.

It is certified that error appears in the above-identified patent and that said Letters Patent is hereby corrected as shown below:

COLUMN 8:

Line 3, "tank 9" should read --tank 901--.

Signed and Sealed this

Eleventh Day of July, 2000

*Attest:*

Q. TODD DICKINSON

*Attesting Officer*

*Director of Patents and Trademarks*